United States Patent [19]

Williams

[11] Patent Number: 4,571,963

[45] Date of Patent: Feb. 25, 1986

[54] MATERIAL TREATMENT APPARATUS

[76] Inventor: Cyril J. Williams, 23 Borrow St., Freeling, State of South Australia, Australia

[21] Appl. No.: 634,708

[22] Filed: Jul. 26, 1984

[51] Int. Cl.[4] ..... D06F 27/00; B01F 11/00

[52] U.S. Cl. ..... 68/171; 51/7; 51/163.1; 74/99 R; 134/118; 209/366; 241/284; 366/111; 366/219

[58] Field of Search ..... 210/384, 388; 209/326, 209/366; 51/7, 163.1; 241/175, 284; 74/99 R; 134/117, 118; 99/348; 366/111, 112, 219; 68/171, 172; 134/164

[56] References Cited

U.S. PATENT DOCUMENTS 4,125,335 11/1978 Blume et al. ..... 241/175 X

FOREIGN PATENT DOCUMENTS 1078001 5/1954 France ..... 241/175
494892 11/1938 United Kingdom ..... 241/175
895588 5/1962 United Kingdom ..... 68/172

*Primary Examiner*—Philip R. Coe
*Attorney, Agent, or Firm*—Pearne, Gordon, Sessions, McCoy, Granger & Tilberry

[57] ABSTRACT

A material treatment apparatus having a bowl or container for the material to be treated. The bowl is suspended by resilient means, and a vertical reciprocating motion is applied to the bowl, the resilient means during the vertical motion imparting a rotary oscillation to the bowl or container.

9 Claims, 4 Drawing Figures

MATERIAL TREATMENT APPARATUS

This invention relates to material treatment apparatus, more particularly an apparatus for the treatment of fluid, granular or other materials of non solid form, in various chemical and manufacturing and other processes, and washing and cleaning of clothes, articles and objects of domestic or industrial nature.

DESCRIPTION OF PRIOR ART

U.S. Pat. No. 1,339,818 discloses a washing machine and more particularly refers to machines for washing clothes, the machine having a casing supported on trunnions which are slidable on vertical guides, springs acting between the trunnions and the base of the machine. A drive mechanism comprising a crank is connected to the bottom of the casing so that in operation the casing will partake of an oscillatory as well as a reciprocatory motion, the drive mechanism comprising a crank and pitman which is connected to the bottom of the casing.

U.S. Pat. No. 1,397,886 shows a washing machine of a rectangular boxlike structure, this being supported on springs so that by grasping the handles and rocking the boxlike structure, clothes can be washed within the machine.

U.S. Pat. No. 1,459,835 is also directed to a washing machine having a swinging receptacle mounted on inclined links so that by manually swinging the receptacle that the washing action is given to the receptacle.

U.S. Pat. No. 1,460,400 illustrates a dishwashing machine having a container within which is provided a basket or the like to contain the dishes to be washed. A drive mechanism provides a vertical plus part reciprocatory motion to the basket within the container.

U.S. Pat. No. 1,648,530 is a washing machine tub having a container supported by gimbal ring at the top, with a crank mechanism at the bottom to provide a swinging motion to the container.

U.S. Pat. No. 1,855,265 discloses a further washing machine which is pivoted on an horizontal axis to provide an oscillatory motion by a handle, springs being provided in order to stabilize the structure and return it to its normal position during oscillation.

U.S. Pat. No. 3,706,210 shows a mobile washing machine which can be carried on a house trailer, camper vehicle or boat or the like so that as the motor vehicle moves the motion causes the wash water to slosh vigorously, the unit comprising a container within which is mounted a buoyant basket to float within the water in the container, the clothes being contained within the basket.

U.S. Pat. No. 4,096,873 discloses an immersion washer in which a rotary or oscillatory motion as well as a vertical motion is applied to the basket or the like containing the parts to be washed by action of a handle onto a cam plate or the like.

U.S. Pat. No. 3,044,089 discloses a golf ball washing machine in which a reciprocatory and part rotary motion is applied to the unit to facilitate the cleaning of the golf ball.

These patent specifications for material treatment or washing apparatus are either operated manually, or have mechanical gearing such as cams, screw threads or the like, or crank action mechanisms to apply the desired motion to the washing or cleaning apparatus.

It is an object of this invention to provide a material treatment apparatus in which a simple drive mechanism is applied, and also which uses a minimum of power to achieve the washing action.

BRIEF STATEMENT OF THE INVENTION

According to the present invention there is provided an apparatus for material treatment, washing and the like, the apparatus comprising a bowl or container, means being provided to impart to the bowl or container an oscillatory vertical motion, and resilient means suspending bowl or container such that the oscillatory motion is converted into a part rotary motion by the suspension means.

DESCRIPTION OF PREFERRED EMBODIMENT

Figure 1:
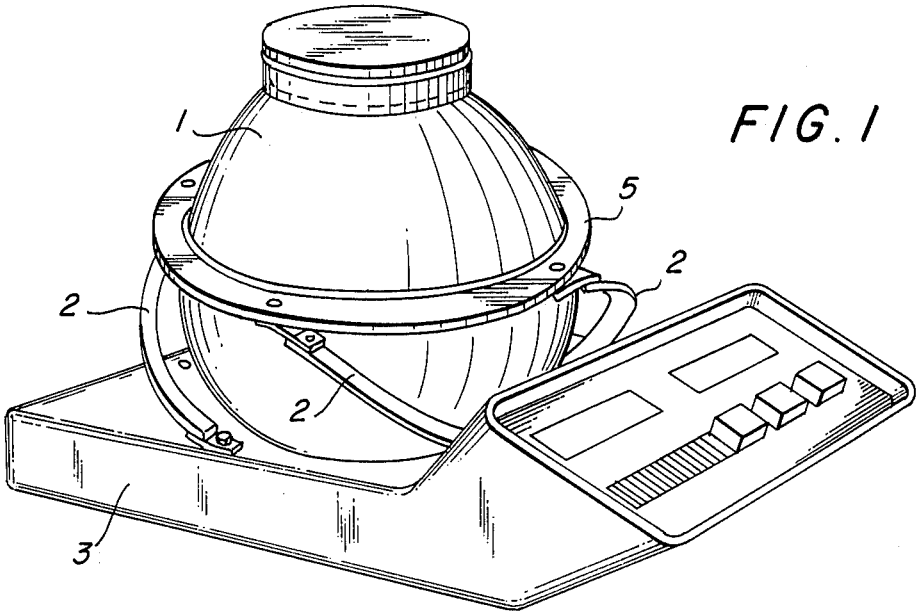
FIG. 1 discloses a perspective view of one form of the invention which is suitable for washing small units, such as a washing machine of toy form for washing dolls clothes.

As shown in FIG. 1 the bowl 1 is supported by resilient straps 2 supporting base 3, the straps being for example three or four in number and positioned around the bowl or container to extend downwardly and being inclined to the vertical, and inclined across the axis of the bowl in what may be termed the same direction of rotation, so that as the bowl is given an oscillatory vertical movement the bowl will also have an oscillatory motion in a rotational sense so that the bowl partakes of a combined vertical and rotational movement.

Figure 2:
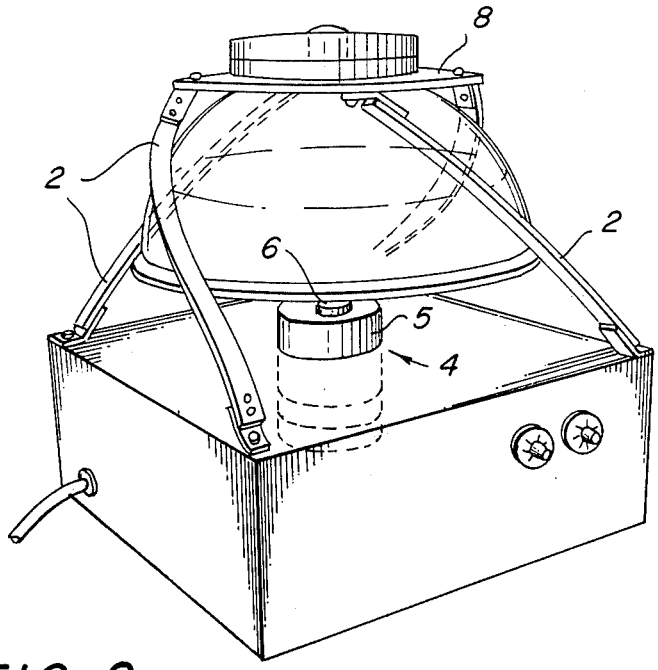
FIG. 2 shows an alternative form of washing machine in schematic form.
Figure 3:
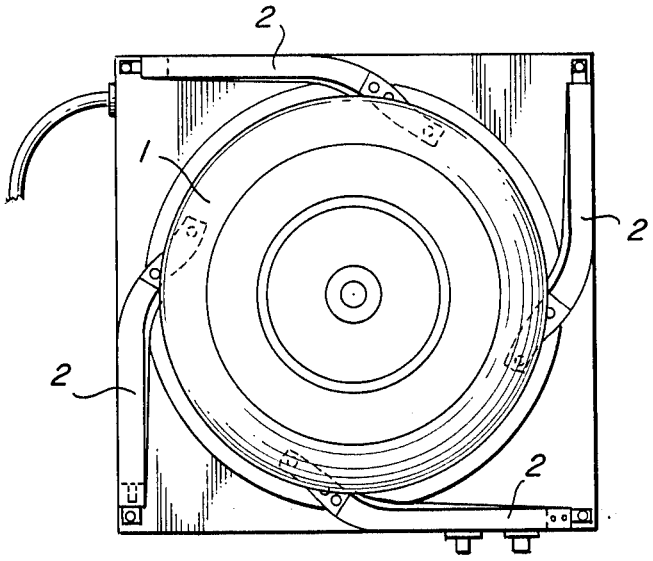
FIG. 3 shows a plan view of FIG. 2.

In order to cause the bowl 1 to have a vertical component of motion, an electromagnet 4 (as shown in FIG. 2) can be positioned at the bottom of the bowl, the magnetic coil 5 being attached for example to the supporting base or the like, while the metallic core 6 is attached to the bowl.

The action of the electro-magnet for smaller units can be in one direction only, and this would be against the action of the resilient straps so that when the electromagnet is disengaged the straps will return the bowl or the like to its original position.

In larger installations the electromagnet can be double acting to assist the resilient straps in returning the bowl to its original position. Preferably the straps are of a resilient plastics material, or alternatively for larger units spring steel or stainless steel straps can be used.

As shown in FIG. 1 the springs or straps 2 are preferably attached to shaped brackets 7 attached to the base, and at their upper ends are either attached directly to the bowl, or to a support strap or ring 8 encircling the bowl 1.

While the bowl is preferably cylindrical, the base 3 could also be circular or could be of rectangular shape with suitable controls for the operation of the washing machine. In FIG. 1 the valves operating the electromagnet could be provided by battery or batteries incorporated within the base, suitable controls and switching such as IC switching units being incorporated in the base 3.

The angle of the inclination of the springs to the base could be any desired angle, and ideally the strength of the springs would be chosen such that when the bowl is loaded with clothes and water, the springs would deflect slightly but still give the required movement.

As shown in FIG. 1, the straps are attached to the ring encircling the bowl at or above the centre of the bowl, it being desired that the ring and attachment of the straps be positioned above the centre of gravity of the bowl when the desired quantity of liquid and clothes are inserted within the bowl.

As shown in FIG. 2 the ring 8 is positioned at the top of the bowl with the straps being extended in length and extending around the bowl and then having a straight portion extending downwardly to the base.

Figure 4:
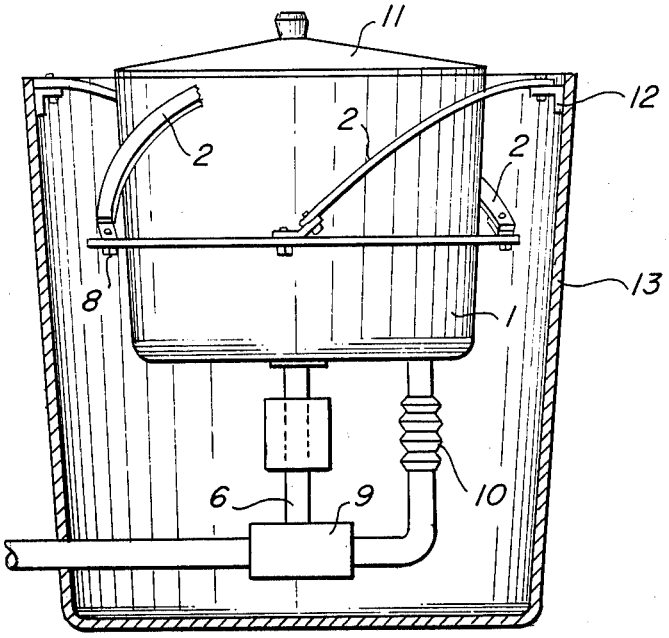
FIG. 4 shows an alternative form of washing machine having means for extraction of the water from the bowl of the washing machine.

As shown in FIG. 4 the unit is disclosed as a washing machine also having means for removing the water from the bowl, and also for partial drying of the clothes.

As shown in the drawings this can include an air or vacuum pump 9, and in a simple form can comprise a bellows or diaphragm type of pump. This can also be operated by the same electromagnet 4, or by a separate electromagnet and its control circuit can be provided. In one form the moving iron core 6 of the electromagnet 4 can extend through the electromagnet 4 to actuate the bellows or diaphragm pump 9 with the pump either continuously operating, or by having a releasable catch mechanism to connect the moving iron core to the actuator for the pump.

A flexible connection 10 can be provided by an opening in the bottom of the bowl to the inlet of the pump, and if desired depending upon the circumstances, a sieve or screen or the like can be provided within the bowl to prevent the goods or material from blocking the outlet from the bowl.

Valve means can be provided in the connection between the bowl and the pump to control the withdrawal of the water, or other medium in the bowl as desired.

Thus the pump while being an air pump can also pump and discharge the water or other liquid either to waste or to be recycled if desired.

A lid 11 can be provided for the bowl to seal the bowl so that a reduced pressure would be created within the bowl to assist the drying of the clothes or other materials within the bowl, so that a certain amount of moisture would be removed due to this lower pressure. The lower the pressure obtained, the more moisture would be transferred to the atmosphere within the bowl to be removed from the clothes or other materials in the bowl.

If desired also the lid can be removed for the drying process so that air would flow through the clothes as they are being tumbled and agitated in the bowl, or alternatively the lid may have a small aperture to allow the regulated passage of air into the bowl through the clothes or other material and in a further alternative heated air may be supplied by a heater incorporated within the lid so that warm air would pass through the clothes for the drying thereof. As shown in FIG. 4, the straps 2 extend upwardly from the supporting ring 8 and are attached to a further ring 12 attached to the supporting framework 13 of the washing machine, so that the bowl is suspended from the further ring 9.

It will be realised that according to the invention there is thus imparted to the bowl an oscillating and agitating movement and while it has been particularly described in relation to a clothes washing machine, the unit can be used in various other processes such as agitation, separation, screening and grading processes, floating processes, cleaning and washing, suspending, polishing, shaking and mixing, and also grinding and milling.

For this purpose the bowl or container can be provided with suitable sieves or screens with appropriate inlet and outlet connections being provided above and or below the screens as desired.

Thus within the bowl or container it will be realised that the bowl or container can be lined with any suitable material for the particular processes envisaged, for example stainless steel, ceramics or even rubber lined when a unit is to be used for the polishing, grinding and milling, for example by the use of abrasive grinding balls or the like.

Also this invention can be applied to domestic cooking apparatus, whereby the slow movement and oscillation of a cooking pot can be achieved, the ingredients such as soups and stews or the like can be kept in constant movement to prevent burning on the bottom, particularly when coming to the boiling stage.

In all the examples, it will be realised that the frequency and the stroke of the electromagnet can be varied as desired, this being easily achieved by suitable control circuits.

While an electromagnet has been described as the means for producing the vertical movement, it is to be realised that other forms of driving units could be provided, either pneumatic or hydraulic, or even mechanical, whereby the resilient springs or straps would create the turning or oscillating movement for the bowl.

Also the movement could be created by other means such as if the unit were positioned in a moving vehicle such as a caravan, mobile home, boat or the like, the rocking and swaying movement of the vehicle would cause the bowl to partake of the agitating movement so that clothes could easily be washed while travelling to a destination and it is merely necessary then to remove the clothes for rinsing and drying.

The claims defining the invention are as follows:

I claim:

1. Material treatment apparatus, said apparatus comprising a bowl or container, characterized by means to impart to the bowl or container an oscillatory vertical motion, and resilient means suspending the bowl or container such that the oscillatory motion is converted into a combined part rotary and vertical oscillatory motion by the suspension means, said means to impart the oscillatory vertical motion comprising an electromagnet mounted on a base supporting the bowl or container, the moveable core of the electromagnet being attached to the bottom of the bowl or container.

2. Material treatment apparatus as defined in claim 1 characterised in that said resilient means are attached to the periphery of the bowl or container and comprise a plurality of resilient straps extending from the bowl to a supporting structure, said resilient straps extending axially and inclined around the bowl in the same direction.

3. Material treatment apparatus as defined in claim 2 characterised in that said resilient straps extend downwardly to a supporting base.

4. Material treatment apparatus as defined in claim 2 characterised in that said resilient straps extend upwardly to a surrounding supporting structure.

5. Material treatment apparatus as defined in claim 2 characterised in that said resilient straps are attached to a ring around the bowl or container, said ring being situated above the centre of gravity of the bowl or container.

6. Material treatment apparatus as defined in claim 1 characterised in that the apparatus is a clothes washing machine.

7. A clothes washing machine as defined in claim 6 characterised in that the clothes washing machine is provided with a pump, the inlet to the pump being connected to the bottom of the bowl or container whereby the pump can extract water therefrom, a lid for the bowl, the pump also reducing the air pressure in the bowl to assist in drying of the clothes.

8. A clothes washing machine as defined in claim 7 characterised in that the pump is a bellows or diaphragm pump operated by three electromagnets.

9. A material treatment apparatus as defined in claim 1 characterised in that the apparatus is an apparatus selected for cleaning apparatus, screening apparatus, floating apparatus, graining apparatus, upgrading apparatus, chemical treatment apparatus, cooking apparatus.

* * * * *